United States Patent [19]

Hill

[11] Patent Number: 4,540,609

[45] Date of Patent: Sep. 10, 1985

[54] METHOD FOR STRENGTHENING LONG CHAIN SYNTHETIC POLYMER FIBERS

[75] Inventor: Dennis B. Hill, Austin, Tex.

[73] Assignee: Hill & Dunn Networks, Inc., Austin, Tex.

[21] Appl. No.: 545,677

[22] Filed: Oct. 25, 1983

[51] Int. Cl.[3] ..... B05D 3/04; B05D 3/10

[52] U.S. Cl. ..... 427/343; 427/353; 427/372.2; 427/430.1; 428/389; 428/689; 428/697

[58] Field of Search ..... 427/372.2, 419.8, 343, 427/333, 354, 353, 352, 419.1, 430.1; 428/389, 394, 395, 689, 697, 290, 477.7; 8/115.6; 252/8.6; 2/239, 409

[56] References Cited

U.S. PATENT DOCUMENTS

| | | | |
|---|---|---|---|
| 1,871,842 | 8/1932 | Dils | 427/372.2 |
| 2,236,074 | 3/1941 | Schwartz | 427/393.4 |
| 2,576,921 | 12/1951 | Buscher | 427/372.2 |
| 2,863,715 | 12/1958 | Goldman | 8/115.6 |
| 3,031,335 | 4/1962 | Segal et al. | 427/394 |
| 3,709,716 | 1/1973 | Liggett | 427/393.2 |
| 3,877,872 | 4/1975 | Vail et al. | 8/115.6 |
| 3,935,370 | 1/1976 | Marti | 428/395 |
| 4,296,174 | 10/1981 | Hanzel et al. | 428/395 |

*Primary Examiner*—Sadie L. Childs

*Attorney, Agent, or Firm*—Arnold, White & Durkee

[57] ABSTRACT

A method for strengthening long chain synthetic polymer fibers involves soaking a fibrous material in a treatment solution of potassium aluminum sulfate or ammonium aluminum sulfate, or both, in water. The treated material is immersed in a fixing solution containing a water soluble metallic carboxylate such as sodium or potassium stearate, and then rinsed with a nonreactive liquid.

16 Claims, No Drawings

METHOD FOR STRENGTHENING LONG CHAIN SYNTHETIC POLYMER FIBERS

BACKGROUND OF THE INVENTION

1. Field of the Invention

The invention relates generally to the field of synthetic fiber strengthening treatments.

2. Background Art

The possibility of a chemical treatment for increasing synthetic fiber strength has been a subject of continuing interest and experimentation in the industry. A strengthening treatment that preserves a fabric's softness and stretchability would be highly desirable. This is because, normally, increased strength is associated with decreased flexibility and softness. For example, in the area of ladies' hosiery, the formation of runners has been a persistent problem, but it would be undesirable to increase strength at the expense of softness or stretchability.

SUMMARY OF THE INVENTION

In accordance with the present invention treatments for strengthening synthetic fibers are achieved by soaking a synthetic fiber or fabric in a treatment solution of alum. In particular, alum solutions which are favored include potassium aluminum sulfate or ammonium aluminum sulfate, or both, in water. The treated material, while still wet with the treatment solution, or after drying, is immersed in a fixing solution containing a water soluble metallic carboxylate such as sodium potassium stearate. Excess chemical products are washed from the treated and fixed material.

DETAILED DESCRIPTION

The present invention is applicable to long chain, synthetic polymer fibers, woven or nonwoven fabric, fibrous systems, finished garments or other fibrous products. The individual fibers are strengthened by a chemical process that may include treating, fixing and rinsing stages which leaves a chemical coating on the fibers. The fibers may be, for example, polyester or nylon.

The fibrous system is first soaked at room temperature for a sufficient time to achieve a thorough wetting, in a treatment solution comprising an aqueous solution of an alum. For example, hydrated ammonium aluminum sulfate ($NH_4Al(SO_4)_2.12H_2O$) or hydrated potassium aluminum sulfate ($KAl(SO_4)_2.12H_2O$) may be used. Alternatively, an aqueous mixture of the ammonium and potassium alums may be used. A variety of relative proportions of the two chemicals are suitable in the two component embodiment. A preferred solution includes 38 grams of ammonium aluminum sulfate and 6.7 grams of potassium aluminum sulfate, per liter of water. An alum concentration from about 5 to 200 grams per liter is preferred and within this range a preferred concentration is from about 25 to about 75 grams per liter, and a particularly preferred concentration is about 44.7 grams per liter. Below the level of 25 grams per liter diminished resiliency may be experienced in treated fabrics.

The treated material, while still wet with the treatment solution, or after drying, may be immersed in a fixing agent such as hard soap (sodium stearate) or soft soap (potassium stearate) in water. Any water soluble metallic carboxylate (R-COOR'), where R is an aliphatic chain and R' is sodium or potassium, may be used as a fixing agent. Forced air drying, using air temperatures under 100° Centigrade prior to fixing is acceptable to dry the treated material.

Excess chemical products are washed from the treated and fixed material with water or another conventional nonreactive solution.

The invention may be better understood by referring to the examples which follow.

EXAMPLE 1

Treatment of Hosiery

This process may be used on synthetic hosiery to prolong wear life. The hosiery should be new and unwashed.

An aqueous alum solution is prepared with an alum concentration between 5 and 200 grams per liter. For purposes of this example, a solution of ammonium alum and potassium alum was prepared with the ammonium alum at a concentration of 38 grams per liter, and the potassium alum at a concentration of 6.7 grams per liter. In addition, solutions of 44.7 grams per liter of each of the alums alone were also prepared. Hosiery is placed into three empty bowls. Each alum solution is then poured over hosiery in a different bowl, at room temperature, until the hosiery is covered by the solution. The solution may be squeezed through the garments until absorbed. This step usually takes about one minute. The excess solution is then wrung out of garments. The hosiery is rinsed in clear water and left to dry.

The fixing process prevents the treatment from gradually washing out with repeated laundering. A fiber coating of an insoluble metallic carboxylate is formed by mixing a quarter teaspoon of soap with two cups of water and immersing the treated hosiery in this weak soap solution. Liquid Amway Cool Wash or Ivory flakes dissolved in the least possible amount of water may be used. The garments are then rinsed in clear water to remove the remaining soap solution and any white residue. Thereafter the garments are hung to dry.

The stearate in the soap reacts with alum solution to form an insoluble metallic carboxylate. With free alum in solution, stearic acid will precipitate out. With bound alum on the fiber surface, the stearate forms an insoluble coating. A very weak solution may be applied so that the smallest amount of free precipitate is formed.

The treated samples all exhibit increased wear life with satisfactory softness and stretchability.

EXAMPLE 2

Treatment of Fibers

This treatment process may be used during manufacture of synthetic fabrics.

After extrusion of synthetic fibers, the fibers can be run through a bath of alum solution prepared as described in Example 1 with a concentration up to the highest solution possible so that absorption can be maximized. Once the alum solution is absorbed into the fibers a water bath can wash off the surface excess. The alum bath can be placed at any stage of manufacture from immediately post extrusion through wearing of the material.

The effects of the treatment will be most noticeable in very delicate fabrics which will be under stress, such as nylon hosiery. Hosiery has a typically short wear life so the effects are most noticeable in this type of garment.

EXAMPLE 3

Densification of Synthetic Fibers

A commercial sample of nylon mesh was divided into three parts so that batch differences would be eliminated. A solution of 60 grams per liter of ammonium aluminum sulfate was prepared. Sixty grams per liter of alum is safe to handle and is in the midrange of acceptable concentrations. One of the nylon samples was treated as in Example 1.

A second alum solution was prepared with 30 grams per liter of ammonium alum, to examine the effects of one half the midrange concentration. Another nylon sample was similarly treated.

The third nylon sample was put through a plain water treatment cycle to act as the control sample.

After treatment the samples were subjected to observation through a scanning electron microscope at a magnification of 2,500 diameters. By way of preparation, the samples were coated with gold by the evaporation technique. They were then mounted on aluminum stubs at the microscope stage. The samples were examined at eight to ten kilovolts power, the instrument being the Phillips 501 B Scanning Electron Microscope.

In the examination of the untreated control sample four random views were photographed by a 4×5 polaroid camera. The first photograph at 2,500 diameters included a micron scale of ten microns to a section by which all subsequent measurements were made. The average diameters of the untreated nylon filament sections was 21 microns.

The nylon sample treated with the midrange concentration of 60 grams per liter of ammonium alum was formed to have an average filament diameter of 18 microns. The sample treated with 30 grams per liter of alum showed an average diameter of 18.5 microns.

The above data was analyzed by the Chi Square test of statistical significance. Comparison of the sample treated with 60 grams per liter to the control gives a "p" value of less than 0.01, that is, the difference in diameters between treated and untreated is not likely to be due to chance. Similarly, the sample treated with 30 grams per liter comparison gives a "p" of less than 0.01. It is interesting to note that comparing the treated samples to each other statistically gives a "p" of greater than 0.05, and this means that they are not significantly different.

The scanning electron microscope gives a graphic demonstration of the unique effect that alum has on synthetic polymer fibers. The higher density that results from the treatment, observed in the filament diameter reduction of ten percent, correlates with the enhanced strength and wear capability.

The present invention is useful in treating a variety of synthetic fibers, fibrous systems, and woven and nonwoven fabrics. Nylon hosiery, treated according to the present invention exhibits increased run resistance while maintaining acceptable stretch and softness. Other applications include the treatment of sailcloth, parachutes, woven apparel, surgical suturing material, gloves and finger cots, and plastic disposables. In addition, the inventive concepts can be applied to create improved synthetic ropes, reinforcing thread, carpet, upholstery, and fishing line.

The embodiments of the invention described are by way of example only, and it is to be understood that changes and modifications might be made thereto without departing from the spirit of the invention. The invention is not to be construed as limited to the embodiments described, except in-so-far as the claims may be so limited.

What is claimed is:

1. A method for strengthening a synthetic fibrous material comprising the steps of:

soaking the material in an aqueous treatment solution of alum wherein the concentration of alum is from about 5 to 200 grams per liter of water;

rinsing the treated material in an aqueous solution; and drying the treated material.

2. The method of claim 1, wherein the alum includes a member selected from the group consisting of hydrated potassium aluminum sulfate and hydrated ammonium aluminum sulfate.

3. The method of claim 2, wherein the concentration of alum is in the range of about 25 to about 75 grams per liter of water.

4. The method of claim 3, wherein the treatment solution comprises about 44.7 grams of alum per liter of water.

5. The method of claim 4, wherein the treatment solution includes about 38.0 grams of ammonium aluminum sulfate per liter of water and about 6.7 grams of potassium aluminum sulfate per liter of water.

6. The method of claim 2, wherein the treatment solution has both potassium aluminum sulfate and ammonium aluminum sulfate.

7. The method of claim 2, including the step of reducing the fiber diameter by at least 10 percent.

8. The method of claim 1, wherein said treated material is nylon.

9. The method of claim 8, wherein said material is nylon hosiery.

10. The method of claim 1 including the step of wetting the treated material with an aqueous fixing solution of a water soluble metallic carboxylate (R-COOR'), where R is an aliphatic chain and R' is an univalent metal.

11. The method of claim 10 wherein said metallic carboxylate is a member selected from the group consisting of sodium stearate and potassium stearate.

12. A method for strengthening a synthetic fibrous material comprising the steps of:

soaking the material in an aqueous treatment solution of alum, wherein the concentration of alum is above about 25 grams per liter of water;

rinsing the treated material in an aqueous solution; and drying the treated material.

13. The method of claim 12 wherein the alum includes a member selected from the group consisting of hydrated potassium aluminum sulfate and hydrated ammonium aluminum sulfate.

14. The method of claim 12 including the step of reducing the fiber diameter by at least 10%.

15. The method of claim 12, wherein said treated material is nylon.

16. The method of claim 12, wherein the concentration of alum is in the range of from about 25 grams per liter to about 75 grams per liter.

* * * * *